United States Patent [19]

Larson

[11] Patent Number: 4,576,297

[45] Date of Patent: Mar. 18, 1986

[54] TAMPER RESISTANT CLOSURE

[75] Inventor: Curtis L. Larson, Hudson, Wis.

[73] Assignee: Minnesota Mining and Manufacturing Company, St. Paul, Minn.

[21] Appl. No.: 742,131

[22] Filed: Jun. 6, 1985

Related U.S. Application Data

[63] Continuation of Ser. No. 553,988, Nov. 21, 1983, abandoned.

[51] Int. Cl.[4] ..... B65D 41/34

[52] U.S. Cl. ..... 215/250; 215/347; 215/350

[58] Field of Search ..... 215/250, 347, 351

[56] References Cited

U.S. PATENT DOCUMENTS

| | | | |
|---|---|---|---|
| 2,077,992 | 4/1937 | Eisen | 215/347 |
| 2,131,774 | 10/1938 | Waring | 215/7 |
| 2,131,775 | 10/1938 | Waring | 215/250 |
| 2,188,946 | 2/1940 | Gutmann | 215/347 |
| 2,620,939 | 12/1952 | Weisgerber | 215/347 |
| 2,646,183 | 7/1953 | Pellett | 215/347 |
| 2,937,481 | 5/1960 | Palmer | 215/347 X |
| 3,330,720 | 7/1967 | Stevens et al. | 215/347 X |
| 3,489,307 | 1/1970 | Wenger | 215/351 X |
| 3,637,101 | 1/1972 | Risch et al. | 215/347 |
| 3,963,845 | 6/1976 | Dukess | 215/347 X |

*Primary Examiner*—Steven M. Pollard

*Attorney, Agent, or Firm*—Donald M. Sell; James A. Smith; John C. Barnes

[57] ABSTRACT

A tamper-indicating container seal for use with sealed containers comprising a translucent cap, having a rupturable membrane placed in the cap which is adapted to seal to the container and means, such as a deposit of adhesive, are provided to bond a portion of the rupturable membrane to the cap.

6 Claims, 4 Drawing Figures

TAMPER RESISTANT CLOSURE

This is a continuation of application Ser. No. 553,988 filed Nov. 21, 1983, now abandoned.

BACKGROUND OF THE INVENTION

1. Field of the Invention

This invention relates to an improvement in caps for bottles or other containers which will provide a visual indication at the point of purchase or before use if the cap has been previously removed, and in one aspect, to an improved cap and liner construction wherein removal of the cap tears out the container seal to give access to the contents.

2. Description of the Prior Art

This invention relates to an improvement in a cap for a container which includes a container seal secured within the cap to afford the consumer the opportunity to readily determine whether or not the cap has been previously opened or tampered with since the container left the manufacturer or packaging company.

The need for seals to seal the container beneath the cap and to seal the cap to the container has become accepted to determine whether or not there was any tampering with the container at the point of purchase. The present invention provides a tamper-indicating inner seal for caps having at least a portion of the top thereof being transparent by which one can readily tell whether or not the cap has been tampered with at the point of purchase.

The need for preventing one from readily removing the seal of a container and replacing the same without detection has been present for some time. One prior patent relating to a rupturable container closure which is used in the seal for a container is shown in U.S. Pat. No. 2,131,774, issued Oct. 4, 1938 to Waring. This patent discloses a cap which is used to force a plate against a liner or gasket to seal the top of the bottle. Between the plate and the cap is a rupturable disc of fibrous or other suitable rupturable material having impressed thereon a safety design of a type making the duplication or counterfitting of such a disc as difficult as possible. It is desirable to bind the disc to the plate by some suitable adhesive or cement. The cap however is provided with prongs which, after the cap is in place, are forced downward to penetrate the rupturable disc in areas above a groove formed in the metal plate. When opening the container it is merely necessary for the user to impart a reverse turning movement to the closure. During the first portion of this movement the metal shell will turn independently of the packing liner or gasket, the plate and the rupturable disc, and the prongs will move along the groove 19 and tear the material of the disc forming jagged and irregular tears in the disc. After the prongs have once been placed through the disc it would be extremely difficult to remove the cap in a manner which could avoid detection.

The invention of the present application provides for the destruction by rupturing, tearing, or disfiguring of the inner seal upon rotation of the cap in much the same manner, but, adhesives are used to adhere a rupturable liner to the inside of the cap. The liner comprises means to bond the inner seal to the container such that movement between the cap and container causes the destruction of the liner and a very visible indication of tampering with this closure.

The present invention has the advantage of being formed for use with normal cap lining equipment and with induction sealing equipment which seals the existing cap liner materials to the container upon the containers being filled.

SUMMARY OF THE INVENTION

The present invention provides a tamper-indicating cap structure suitable for use on a wide variety of containers comprising a translucent cap or a cap having at least a portion of the top thereof translucent or transparent, and an inner seal placed in the cap for sealing to the container after the same has been filled. The inner seal comprises a disc of rupturable material adapted to be sealed to the inner surface of the top of the cap and secured to the upper surface of the neck of the container. A deposit of adhesive seals the rupturable disc to the cap and is placed into the cap. The cap inner seal material may be punched from a web of material and placed in the cap utilizing standard machinery for inserting cap liners in the caps. The adhesive is applied to the cap and the seal material is placed in the cap, then the seal material is pressed into the cap to contact the adhesive to the cap and disc. After the container is filled the cap and inner seal will be placed on the container. Induction heating may be utilized to seal the inner seal to the container about the opening thereof. The adhesive between the cap and the rupturable material, which is adhered to the container, will cause the rupturable disc to tear as the adhesive moves with the cap relative to the container. The same rupturing occurs with a translucent polymeric cap whether threaded on or snapped on over a rib or shoulder formed around the open end of the container when the cap is rotated to the open position.

The rupturable disc is preferably formed of a thin layer of metal foil such as aluminum which is coated with a heat sealable layer such as polyethylene. The rupturable disc would preferably be printed or coated with colored materials to readily expose in the ruptured areas of the rupturable disc indicating that the container has been opened or attempted to be opened.

Other suitable materials include paper, thin films, perforated films or foils or a composite of two foils each coated with a sealing layer.

BRIEF DESCRIPTION OF THE DRAWINGS

This invention will be further described with reference to the accompanying drawing wherein.

DESCRIPTION OF THE PREFERRED EMBODIMENTS

Figure 1:
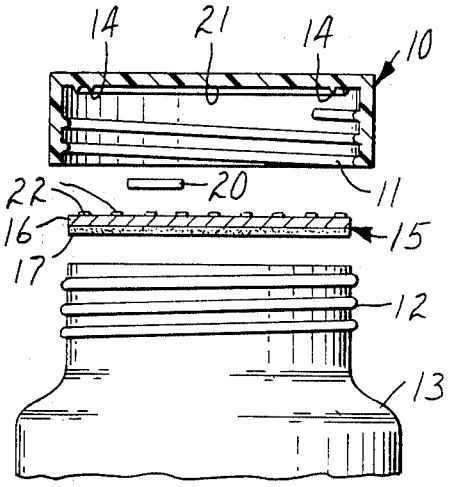
FIG. 1 is an exploded view with the cap and liner in vertical section to illustrate interior features.

The present invention provides an improved tamper-indicating closure for a container which when sealed to a container will provide a readily detectable tamper-indicating closure for the container. As illustrated in the attached drawing, where similar numerals on the various figures illustrate identical parts, a cap 10 formed of a translucent polymeric material, e.g., a transparent polyolefin and having internal threads 11 is adapted to mate with the threads 12 provided on the outer cylindrical surface of the neck of a container 13. The cap 10 may be provided with annular ribs 14 formed in the top of the cap and positioned to be opposite the upper surface of the neck of the container. The ribs 14 terminate in narrow edges for concentrating the sealing heat and pressure in this region.

A cap liner is placed inside of the cap and this is usually done by the cap manufacturer, and the caps are supplied to the packager with the liner placed in the cap. The cap liner is generally designated by the reference numeral 15 and comprises a disc 16 of rupturable material coated with a sealing layer 17. A deposit of adhesive 20 is placed in the cap 10 for adhering the disc 16 to the interior surface 21 of the top of the cap 10. At least a portion of this top must be translucent as will be explained below.

The web from which the cap liner 15 is die cut comprises the layer 16 of aluminum foil which may be 0.001 inch (1.0 mil) in thickness, although foils from 0.002 inch (2.0 mils) and thinner have been used with success. The layer 16 has a coating 17 of a heat sealable material such as polyethylene. Indicium, formed by a layer 22, preferably an ink, is printed on the surface of the layer 15 opposite the adhesive coating. The indicium 22 may alternatively be a layer of colored material. The deposit of adhesive 20 may be a spot of adhesive used to join the layer 16 to the surface 21 of the cap. Spots of adhesive may be placed also in a random dot pattern on the web from which the liner 15 is cut. The adhesive is preferably a spot of Jet Melt 3764 adhesive available from Minnesota Mining and Manufacturing Company, St. Paul, Minn., U.S.A. This adhesive is a hot melt adhesive. Spots or strips of a strong pressure-sensitive adhesive could be substituted.

Figure 2:
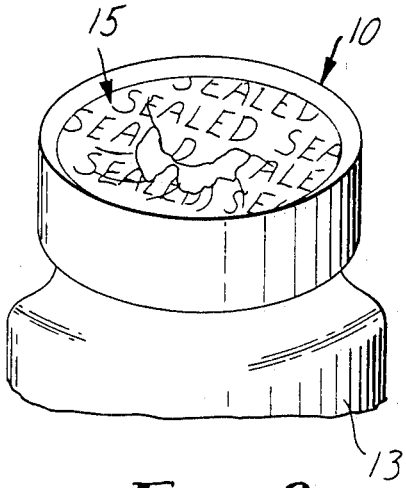
FIG. 2 is a fragmentary top perspective view showing the cap turned and the liner ruptured.

When sealed to a container 13 the cap 10 is positioned tightly on the neck of the container, the adhesive 20 seals the disc 15 to the cover 10 and the layer 17 seals the disc 15 to the surface of the container surrounding the container opening. As illustrated in FIG. 2, when the cover is turned in a counterclockwise direction to remove the cover equipped with screw threads, the adhesive 20 tears the disc 15 due to the relative movement between the cover and disc. A similar rupture would occur if the cover were turned to a position matching an arrow on the cover with an arrow on the container to permit the cover to be lifted off the container. The removal of the cap thus also tears out the container seal affording direct immediate access to the contents without breaking another seal. This package could then be used for the sterile delivery of medical devices or materials in operating rooms, clinics etc. After the package is sealed, sterilization by ethylene oxide gas or gamma radiation can sterilize the contents, and they can be delivered sterile by removing the cap, thus tearing the seal, and emptying the container.

Figure 3:
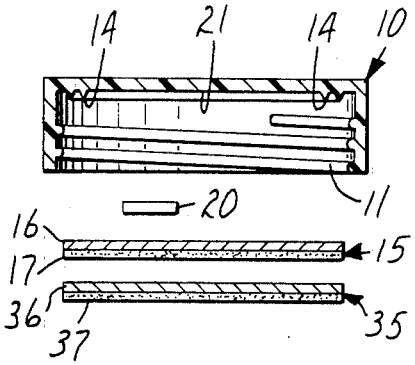
FIG. 3 is a diagrammatic sectional view of a second embodiment of a cap and liner constructed in accordance with the present invention.

FIG. 3 illustrates a further embodiment of the present invention wherein the cap 10 has a disc 15 sealed by adhesive 20 to the cap. A second disc 35 is placed in the cap in contact with the disc 15. Disc 35 may comprise a layer 36 of metal foil coated with a heat sealable material 37. When placed on a container the induction heating process causes the disc 15 to bond about its periphery to the layer 36 which in turn is bonded to the edge of the container surrounding the opening by layer 37.

The disc 15 may be color coated or printed with suitable ink 22 to bear a desired message or the manufacturer's logo. The disc 35, or layer 36 thereof is printed with indicia of contrasting color or coated with a contrasting color to be clearly visible when the disc 15 is torn to indicate the cover has been tampered with or opened.

The present invention provides a cap liner which provides a tamper indication and the use of metal, i.e., aluminum foil, for the rupturable layer 16, and for layer 36 allows the sealing layers 17 and 37 to be a normally nontacky material activated to have adhesive quality when the assembled cap, liner and container are exposed to energy to inductively heat the foil layers to activate the sealing layers. The layer 16 however could be a paper or perforated film material and easily rupturable which is bonded by a pressure-sensitive adhesive coating 17 to the contrasting layer 36 of the disc 35. Relative rotational movement would result in the paper or film layer being torn and peeled from the layer 36 exposing the layer 36 through the cover 10.

Figure 4:
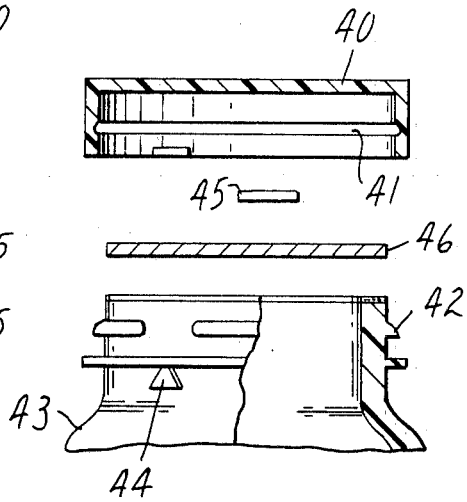
FIG. 4 is a diagrammatic sectional view of a cap, liner and container constructed according to a further embodiment.

In FIG. 4 a cap 40 is illustrated which is of the child-resistant type which has a recess 41 formed on the side walls to mate over an interrupted rib 42 on the container 43. The cap 40 and container 43 each have an arrow 44 molded therein or placed thereon to permit the discontinuity in the rib 42 to be aligned with the projection in the cap 40 to permit removal of the cap.

A deposit of adhesive 45 in the form of a spot of curable adhesive or a strip of pressure-sensitive adhesive extending across a surface of a disc 46 adheres the disc 46 to the cover. As illustrated in the drawing the adhesive is positioned in the cover within the area of the opening spaced from the surface defining the opening and is spaced from the center of said cover whereby relative movement of the cap and the cover, especially rotational, causes a tearing of the container seal. The disc 46 may be 0.001 inch (1.0 mil) dead soft aluminum foil.

In this embodiment an activatable adhesive material is coated on the container 43 on the surface surrounding the opening. This adhesive will bond the disc 46 to the container. One adhesive substance may be an ethylene vinyl acetate which will bond upon the application of heat. Other suitable adhesives may be coated on and activated by pressure.

Having disclosed the invention with reference to several embodiments it is understood that modifications can be made without departing from the spirit or scope of the invention as defined in the appended claims.

I claim:

1. A closure for a container having a surface surrounding an opening to the container, a removable translucant cover member removably mounted over said opening in the container, a membrane defining a seal for said container which is bonded in fixed relationship to said surface of said container surrounding said opening, and a deposit of adhesive adhered to the inside of said cover member and to said membrane, said deposit of adhesive being spaced from the surface surrounding said opening and being spaced from the center of said cover whereby relative movement between the cover member and said container will cause a tearing of said membrane by said deposit of adhesive within the area of said opening.

2. A closure according to claim 1 wherein said membrane comprises a disc of metallic foil.

3. A closure according to claim 2 wherein said metallic foil has a coating of heat-activatable adhesive material coated on the surface thereof adjacent said surface surrounding said opening to the container to bond said disc to said surface.

4. A closure according to claim 1 wherein said membrane comprises a readily rupturable membrane which will tear easily upon relative movement between said cover member and said container to open said container at said opening permitting access to the contents of said container.

5. A closure according to claim 4 wherein said membrane comprises a perforated film material.

6. A closure according to claim 1 wherein said membrane comprises a readily rupturable disc adhered to said deposit of adhesive and a second disc is adhered to said rupturable membrane adjacent the outer edges thereof, said second disc is bonded to the surface of said container surrounding said opening, and said rupturable disc and said second disc are formed to differ visually such that relative rotational movement of said cover member and said container affords a tearing of said rupturable disc to expose said second disc through said cap and visually indicate the cover member has been tampered with or opened.

* * * * *